US005632782A

United States Patent [19]

Carlough

[11] Patent Number: 5,632,782

[45] Date of Patent: May 27, 1997

[54] EXHAUST DYEING PROCESS FOR SULPHUR DYES

[75] Inventor: Mark S. Carlough, Concord, N.C.

[73] Assignee: Clariant Finance (BVI) Ltd., Virgin Islands (Br.)

[21] Appl. No.: 518,626

[22] Filed: Aug. 23, 1995

Related U.S. Application Data

[63] Continuation-in-part of Ser. No. 299,763, Sep. 1, 1994, abandoned.

[51] Int. Cl.[6] ..... D06P 1/30; C09B 49/00

[52] U.S. Cl. ..... 8/474; 8/475; 8/630; 8/631; 8/586; 8/587; 8/651; 8/652; 8/918

[58] Field of Search ..... 8/650–652, 474, 8/475, 586, 587, 630, 631, 918

[56] References Cited

U.S. PATENT DOCUMENTS

| | | | |
|---|---|---|---|
| 1,733,439 | 5/1929 | Wakefield | 8/652 |
| 4,082,502 | 4/1978 | von der Eltz et al. | 8/476 |
| 4,801,303 | 1/1989 | Carlough et al. | 8/532 |
| 4,917,706 | 4/1990 | Meszaros | 8/652 |
| 5,030,248 | 7/1991 | Meszaros | 8/652 |
| 5,378,246 | 1/1995 | Gurley | 8/625 |

FOREIGN PATENT DOCUMENTS

| | | | |
|---|---|---|---|
| 60-17185 | 1/1985 | Japan . | |
| 60-119285 | 6/1985 | Japan . | |
| 2011486 | 7/1979 | United Kingdom | D06P 1/30 |

*Primary Examiner*—Margaret Einsmann
*Attorney, Agent, or Firm*—Robert S. Honor; Carl W. Battle; Thomas C. Doyle

[57] ABSTRACT

Improved processes for the exhaust dyeing of cellulosic fibers with sulphur dyes in the presence of non-sulphide reducing agents wherein the dyeing of the textile substrate is performed in a closed vessel in an atmosphere of reduced oxygen level and then oxidizing.

39 Claims, No Drawings

EXHAUST DYEING PROCESS FOR SULPHUR DYES

This application is a continuation-in-part of application Ser. No. 08/299,763, filed Sep. 1, 1994, now abandoned.

The present invention relates to exhaust dyeing processes useful for the dyeing of cellulosic and cellulosic-mixed fiber materials.

As has been known for many years, sulphur dyes are advantageously used in the dyeing and/or printing of cellulose fiber materials and/or cellulosic blended textile fibers. In traditional dyeing processes the sulphur dyes are applied in the alkali soluble (pre)reduced form, i.e. "leuco state", and are brought in contact with the cellulosic fibers in one of a variety of methods and subsequently oxidized in order to achieve color development and/or impart a degree of dye fastness to the dyed cellulosic textile substrate.

Reducing agents traditionally employed for the application of sulphur dyes are in particular: sodium hydrogen sulphide, sodium sulphide and sodium polysulphides. Other chemical reducing agents that do not contain sulphide ions (i.e. "non-sulphide" reducing agents) known to be useful for the reduction of sulphur dyestuffs include: sodium borohydride, formamidinesulphinic acid, glyceraldehyde, hydroxyacetone, hydroxylamine sulphate, lignin sulphonates, sodium formaldehydesulphoxylate, sodium hydrosulphite, thioglycolic acid, and various reducing sugars. While effective, these reducing agents are known to the art to suffer certain disadvantages. For example, while sulphides are known as particularly effective reducing agents which are relatively insensitive to air oxidation, they raise serious concerns regarding safety, offensive odors, and waste disposal. On the other hand, the use of "non-sulphide" reducing agents provide the advantage in that they do not presently raise the same degree of environmental concern and appropriate waste disposal as sulphide-comprising reducing agents, but they are limited in their utility in great extent due to the instability of their corresponding reduction bath to oxidation in the presence of atmospheric oxygen. This is particularly the case with sulphur dyes other than the sulphur black dyes. Further, in the use of particular types of dyeing apparatus, especially winch-beck and jet dyeing machines, where due to the nature of the transport of the textile material being dyed which inherently entrains air (and thus oxygen) therein, the use of such "non-sulphide" reducing agents has been mostly unsuccessful, except to some extent wherein the dye used is a sulphur black dye.

Therefore, it is among the objects of the present invention to provide an improved process for the dyeing of cellulosic and cellulosic-mixed fiber materials utilizing one or more sulphur dyes and utilizing one or more non-sulphide reducing agents, and especially when utilizing non-black sulphur dyes.

The invention thus provides a process for the dyeing of cellulosic fibrous material with a sulphur dye by exhaust dyeing which comprises contacting the fibrous material with an aqueous dyebath that contains at least one sulphur dye (S) in at least partially soluble form ($S_A$) and at least one non-sulphide reducing agent (R), in a closed vessel in an atmosphere of reduced oxygen level and then oxidizing.

As an atmosphere of reduced oxygen level there is meant here an atmosphere in which the oxygen content is inferior to the one of normal air, which contains about 21% by volume oxygen. Desirably, the atmosphere of reduced oxygen level contains no more than 12% oxygen by volume, preferably no more than 10% by volume.

By "cellulosic fibrous material" is to be understood a substrate which comprises cellulose fibers and which may further comprise non-cellulosic fibers which may be mixed with the cellulosic fibers, and is preferably textile material. Contemplated non-cellulosic fibers include semisynthetic and fully synthetic polymeric fibrous material including, but not limited to, cellulose acetates, polyarnide (including also aramide), polyesters, polyolefin, polyacrylonitrile, as well as others known in the art as useful in forming mixed fiber blends with cellulose fibers. Further, the fibers may be in any conventional form including but not limited to, raw stock, threads, yarns, or in semi-finished product form, that is to mean, in the form of twisted hanks or skeins of yarns or fibers, spooled threads, knitted or woven textile such as fabrics, as well as in final product form such as garments. The fibrous material, in particular the textile material, will usually contain at least 15% by weight of cellulose fibers, more usually at least 40% by weight, i.e. 40 to 100% by weight of cellulose fibers.

The sulphur dyes (S) which may be used in accordance with the process of the invention include those which are either provided in the non-reduced form ($S_1$) for subsequent reduction by non-sulphide sulphur dye reducing agent(s) in the application bath, or they may be provided to the bath as (pre)reduced sulphur dyes ($S_2$), in particular as liquid concentrated compositions, which are frequently aqueous alkaline solutions containing the alkali soluble leuco sulphur dye thiolate, or as dry compositions. As (pre)reduced sulphur dyes ($S_2$) there are more specifically meant prereduced sulphur dyes ($S_2'$) which are in a partially reduced form as is sufficient in order to be readily soluble in alkaline solutions and which may, if desired, be further reduced for application, and further or fully reduced sulphur dyes ($S_2''$) which are readily soluble in alkaline solutions and are directly usable for application. Both ($S_2'$) and ($S_2''$) are embraced by the term leuco sulphur dyes. Solubilized sulphur dyes (Bunte salts) ($S_3$) may also be employed according to the invention. The dyes ($S_A$) which are at least partially dissolved in the alkaline dye liquor, are alkali soluble forms of sulphur dyes such as Bunte salts ($S_3$), prereduced sulphur dyes ($S_2'$), further reduced sulphur dyes ($S_2''$) or alkali soluble thionation products ($S_1''$). Where the dye is in non-soluble form ($S_1'$) a soluble form will be formed in the (R)-containing dyebath. In the dyebath the dissolved dyes ($S_A$) are further reduced, where required or desired, to a reduced form ($S_A'$) suitable for dyeing, which comprises in particular ($S_2$) and at least partially reduced forms of ($S_3$), i.e. ($S_3'$).

Exemplary sulphur dyes (S) which may be utilized in accordance with the process of the invention include but are not necessarily limited to the following ("C.I." stands for "Colour Index"):

C.I. Sulphur Yellow 1, 2, 3, 4, 5, 6, 8, 9, 10, 11, 12, 13, 14, 16, 20 and 23, C.I. Leuco Sulphur Yellow 2, 4, 7, 9, 12, 15, 17, 18, 21, 22 and 23 and C.I. Solubilized Sulphur Yellow 2, 4, 5, 19, 20 and 23;

C.I. Sulphur Orange 1, 2, 3, 4, 5, 6, 7 and 8, C.I. Leuco Sulphur Orange 1, 3, 5 and 9 and C.I. Solubilized Sulphur Orange 1, 3, 5, 6, 7 and 8;

C.I. Sulphur Red 1, 2, 3, 4, 5, 6, 7, 8, 9, 10, 12 and 13, C.I. Leuco Sulphur Red 1, 4, 5, 6, 11 and 14 and C.I. Solubilized Sulphur Red 3, 6, 7, 11 and 13;

C.I. Sulphur Violet 1, 2, 3, 4 and 5, C.I. Leuco Sulphur Violet 1 and 3 and C.I. Solubilized Sulphur Violet 1;

C.I. Sulphur Blue 1, 2, 3, 4, 5, 6, 7, 8, 9, 10, 11, 12, 13, 14, 15, 16, 17, 18 and 19, C.I. Leuco Sulphur Blue 1, 2, 3, 5, 7, 8, 9, 11, 13, 15 and 20 and C.I. Solubilized Sulphur Blue 1, 2, 4, 5, 6, 7, 10, 11, 13, and 15;

C.I. Sulphur Green 1, 2, 3, 4, 5, 6, 7, 8:1, 9, 10, 11, 12, 13, 14, 15, 16, 17, 18, 19, 20, 21, 22, 23, 24, 25, 26, 27, 28, 29, 31, 32 and 33, C.I. Leuco Sulphur Green 1, 2, 3, 4, 7, 11, 16 30, 34, 35, 36, and 37 and C.I. Solubilized Sulphur Green 1, 2, 3, 6, 7, 9, 19, 26 and 27;

C.I. Sulphur Brown 1, 2, 3, 4, 5, 6, 7, 8, 9, 10, 11, 12, 13, 14, 14:1, 15, 15:1, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 53:1, 54, 55, 56, 57, 58, 59, 60, 61, 62, 63, 64, 65, 66, 67, 68, 69, 70, 71, 72, 73, 74, 76, 77, 78, 79, 84, 85, 87, 88, 89, 90, 91, 93 and 94, C.I. Leuco Sulphur Brown 1, 3, 4, 5, 8, 10, 11, 12, 14, 15, 21, 23, 26, 31, 37, 43, 44, 81, 82, 86, 87, 90, 91, 92, 93, 94, 95 and 96 and G.I. Solubilized Sulphur Brown 1, 4, 5, 8, 10, 11, 12, 14, 15, 16, 21, 26, 28, 31, 51, 52, 56, 60, 75, 80 and 83;

C.I. Sulphur Black 1, 2, 3, 4, 5, 6, 7, 8, 9, 10, 11, 12, 13, 14, 15, 16 and 17, C.I. Leuco Sulphur Black 1, 2, 6, 9, 10, 11 and 18 C.I. Solubilized Sulphur Black 1, 2, 5, 7 and 11.

A more complete and particularized listing of the dyestuffs mentioned above may be found in the Colour Index, 3rd. Ed., published by the Society of Dyers and Colourists (London, GB), as well as in the supplementary volumes published thereto.

Particular sulphur dye colors with which the inventive process is particularly useful include yellow, orange, red, violet, blue, green, brown and combinations thereof, particularly preferred being the blue (including also navy blue) dyes.

In accordance with the invention, a non-sulphide reducing agent (R) is employed in the dyebath; it may be utilized to reduce a sulphur dye ($S_1$) or ($S_3$) or a prereduced dye ($S_2'$) present in the dyebath or to maintain the reduced condition (leuco form) of (pre)reduced dyes ($S_2$).

The dyes (S) may be employed in a form as commercially available; the soluble reduced or prereduced, i.e. leuco sulphur dyes ($S_2$), may in particular be employed in a form as commercially available, and which may contain some residual excess reducing agent from their production, and, especially in the liquid form, may contain if required or desired, some added reducing agent in order to stabilize the reduced form against an oxidizing influence of the surrounding air.

It is of advantage, in particular for ecological reasons, that any sulphide content of (S) be as low as possible, preferably<3%, more preferably<0.1% referred to the dry weight of the dye.

Suitable non-sulphide reducing agents (R) include those mentioned above, among which the organic ones are preferred, in particular reducing sugars, hydroxyacetone, glyceraldehyde, sodium formaldehyde sulphoxylate, formamidine sulphinic acid and thioglycolic acid. More preferably (R) is a reducing agent that is free of nitrogen and sulphur atoms, in particular reducing sugars, hydroxyacetone or glyceraldehyde, of which the reducing sugars are most preferred.

Particular advantages accompanying the use according to the invention of non-sulphide reducing agents (R), in particular the organic ones, and especially the more preferred ones, before all the reducing sugar(s) for the reduction of the sulphur dye include: a safer chemical system due to lower potential for the generation of hazardous hydrogen sulphide gas, if the application bath is acidified, as compared to sulphide reducing agents; reduced environmental concerns regarding waste disposal as the non-sulphide reducing agents (R), in particular the organic ones, and especially the more preferred ones, before all the reducing sugar(s) are readily biodegradable, as well as elimination of unpleasant odors emanating from the aqueous sulphur dyebath.

A preferred class of non-sulphide reducing agents thus includes reducing sugars, which in the process according to the invention are particularly effective in the reduction of sulphur dyes ($S_1$) and also ($S_3$) or ($S_2'$) to their reduced form and thus make them amenable for dyeing of a cellulosic or cellulosic mixed fiber material. It is to be understood that as effective reducing sugars there are considered those that are capable of reducing the Fehling's solution and include a wide variety of carbohydrates, in particular mono- and oligosaccharides, some of which are already known to the relevant art. Reducing sugars contemplated as useful are those categorized but not limited to aldo- and/or keto- triose, tetrose, pentose and hexose. Examples of such reducing sugars include fructose, galactose, glucose, mannose, maltose and lactose; other reducing sugars which are effective in reducing Fehling's solution and thus also a sulphur dye to its (pre)reduced form may also be used.

Sodium hydrosulphite, also known as sodium dithionite, has been known to the art as a useful reduction agent for vat dyes as defined in the Colour Index, but its use in conventional sulphur dyebaths has not found widespread acceptance due to the observed difficulties in the control of the degree of reduction of the sulphur dye. The overreduction of some sulphur dyes leads to the destruction of the dyestuff chromophore, while underreduction gives instability of the reduced bath toward air oxidation leading to "bronzy" dyeings, both of which result in ultimate shade variations and deviations observed in the final dyed product as that originally intended and expected. These disadvantages are overcome by the invention.

Thiourea dioxide, also known as formamidinesulphinic acid, has also been known to the art as a useful reducing agent for vat dyes but has not found widespread acceptance for use in sulphur dye application due to the same difficulties mentioned above for sodium hydrosulphite, namely the inconsistent reduction of the sulphur dyestuff. These disadvantages are overcome by the invention.

The dyeing is suitably carried out under alkaline conditions, preferably at a pH≧10, in particular in the range of 10 to 14, preferably 10.5 to 13, most preferably 11 to 12.5. The liquor-to-goods ratio may be in any range as suitable for dyeing methods in closed vessels, in particular in winch becks or jet-dyeing machines, and is advantageously in the range of 4:1 to 20:1, preferably 6:1 to 12:1, most preferably 8:1 to 10:1. The concentration of (R) may be chosen depending on the employed kind, amount and concentration of the dye and on the nature of (R) and may further vary depending on the kind of substrate and particular dyeing method. The reducing agent (R) is suitably added in any amount which is found to adequately reduce a sulphur dye, in particular ($S_1$) and also ($S_3$) or ($S_2'$), to its reduced form under the operating dyeing conditions, and/or to maintain the reduced condition of (pre)reduced sulphur dyes, in particular ($S_2$). Advantageously the concentration of the reducing agent (R) may range in the scope of 0.5 to 15%, preferably 1 to 10%, more preferably 2 to 6%, most preferably 3 to 5% by weight referred to the dry weight of the substrate. Also the dyeing temperature may vary depending on the dyeing method and apparatus, and is advantageously in the range 35° to 130° C., mostly 45° to 105° C., preferably 60° to 100° C.

Generally amounts of 1 gram/liter ("g/l") to 10 g/l of reducing sugar, e.g. glucose, are preferred to effect such a reduction at dyeing temperatures of 70° C. to 130° C. where the sulphur dye is present in a concentration necessitated by the dyeing condition and depth and shade desired.

For aqueous dyebaths wherein sodium hydrosulphite is used as the reducing agent, the sodium hydrosulphite is preferably added in amounts of 1 g/l to 4 g/l in order to effectively reduce a sulphur dye ($S_1$) and also ($S_3$) or ($S_2'$). Amounts greater or lesser than this are contemplated depending upon the aqueous sulphur dyebath within which the sodium hydrosulphite is used. Further, the dyebath temperatures may be those which are generally used in the art for sulphide reduced sulphur dyebaths and are generally in excess of 38° C., with good results being obtained in the temperature range of 49° C. to 105° C., more particularly from 60° C. to 100° C. and especially from 70° C. to 93° C.

For aqueous dyebaths wherein thiourea dioxide is used as a reducing agent, the thiourea dioxide is preferably added in amounts of 1 g/l to 4 g/l in order to effectively reduce the sulphur dye ($S_1$) and also ($S_3$) or ($S_2'$). Amounts greater or lesser than this are contemplated depending upon the aqueous sulphur dyebath within which the thiourea dioxide is used. Further the dyebath temperatures may be those which are generally used in the art for sulphide reduced sulphur dyebaths and are generally in excess of 38° C., with good results being obtained in the temperature range of 49° C. to 105° C., more particularly from 60° C. to 100° C., and especially from 70° C. to 93° C.

For aqueous dyebaths wherein thioglycolic acid, also known as mercaptoacetic acid, is used as the reducing agent, the thioglycolic acid is preferably added in amounts of 1 g/l to 5 g/l in order to effectively reduce the sulphur dye ($S_1$) and also ($S_3$) or ($S_2'$). Amounts greater or lesser than this are contemplated depending upon the aqueous sulphur dyebath within which the thioglycolic acid is used. Further, the dyebath temperatures may be those which are generally used in the art for sulphide reduced sulphur dyebaths and are generally in excess of 38° C., with good results being obtained in the temperature range of 49° C. to 105° C., more particularly from 60° C. to 100° C., and especially from 70° C. to 93° C.

Other non-sulphide reducing agents which are known to be effective in the reduction of sulphur dyes may also be utilized in accordance with the present invention. A further advantage of the invention is that less reducing agent may be used than otherwise would be required.

The suitable or preferred amount of (R) depends mainly on the kind and amount of (S) and is e.g. in the range of 0.5 to 10 g/l, referred to the volume of the dyeing liquor. Even if the dye (S) is provided in (pre)reduced form ($S_2$) a certain amount of(R) must be present in the liquor, preferably 0.5 to 5 g/l, depending also on the nature of the substrate and amount of entrapped air conveyed by and in the substrate and in order to maintain a non-oxidized condition during the dyeing. The amount of reducing agent (R) which may optionally be present in a commercial form of ($S_2$) may also be taken into account in this. The process may be used with any sulphur dyeing process employing non-sulphide reducing agents or even in the absence of a reducing agent (R). For example, in the case of a non-reduced form of a sulphur dye ($S_1$) or ($S_3$), a non-sulphide reducing agent (R) is employed, while, in the case of a (pre)reduced form of a sulphur dye ($S_2$), as indicated above, the presence of added reducing agent (R) may not be required. Such processes are typically carried out in aqueous alkaline dye liquors.

According to a particular feature of the invention the reducing agent (R) is employed in the presence of a chelating agent (C), in particular of an exhaustively carboxymethylated derivative of a lower amino compound, such as ethylenediaminetetraacetic acid or diethylenetriaminepentaacetic acid or nitrilotriacetic acid, preferably in alkali metal salt form, e.g. in a concentration in the range of 0.1 to 2% by weight of (C) referred to the dry weight of the substrate, e.g. in the range of 1 to 20% by weight of (C) referred to the weight of (R). Where a leuco sulphur dye ($S_2$) is employed in the form of a concentrated (R)-containing composition, a chelating agent (C) may also already be present in such a composition, which preferably is alkaline, e.g. in a proportion of 3 to 40 parts by weight of(C) for every 100 parts by weight of($S_2$). In these concentrated compositions the ($S_2$) content is preferably $\geqq$8.5%, mostly$\geqq$12% by weight; they may be aqueous or dry and are preferably alkaline.

In accordance with a particular embodiment of the invention, the first stage of the dyeing process of the invention is characterized by bringing the cellulosic fiber in contact with a sulphur dye dyebath in the presence of a non-sulphide reducing agent (R) and in the presence of an inert gas which may be used to either form a blanket of an inert gas and/or to purge the atmosphere in contact with the dyeing bath. During the exhaustion stage, the inert gas is used to maintain the inert gas atmosphere above or in contact with the dyebath, so as to maintain an inert atmosphere within the dyeing apparatus. In an alternative embodiment, the first stage of the dyeing is accomplished under a vacuum or reduced pressure. In a still further embodiment of the invention, the first stage of the dyeing is accomplished subsequent to or immediately after flushing of the atmosphere with steam and introduction of another inert gas which is subsequently used to maintain the inert atmosphere within the dyeing apparatus. The process as described herein is especially advantageous in winch-beck and in jet dyeing apparatus.

Inert gases suitable for the process of the invention include one or more of the noble gases (preferably argon), nitrogen or steam and in addition may include carbon dioxide, as well as others. The limiting factor of the selection of these gases is that the gases do not have a tendency to react with, in particular to oxidize, the reduced sulphur dyestuff within the dyeing liquor contained within the apparatus, and can effectively reduce the amount of oxygen contained in the trapped atmosphere to levels described above. Preferably, the inert gas is nitrogen, a noble gas or carbon dioxide, more preferably nitrogen or a noble gas, most preferably nitrogen.

In accordance with an embodiment of the inventive process, the substrate to be dyed is provided to a conventional dyeing apparatus within which the non-liquid filled internal volume, i.e. "trapped atmosphere" or more simply "atmosphere", is first flushed with an inert gas in order to reduce the amount of oxygen contained in the trapped atmosphere to not more than 12% by volume, preferably not more than 10% by volume, and most preferably not more than 7% by volume. A reduction to a total absence of oxygen is within the scope of the invention, but unnecessary and expensive to achieve. Preferably, the oxygen level will be from 0.5% to 7.0% by volume, still more preferably from 1.0% to 5.0% by volume. The indicated reduced oxygen levels are advantageously maintained throughout the first stage of the dyeing operation, i.e. the exhaustion of the at least partially reduced and soluble dye ($S_A'$).

Two classes of dyeing apparatus, which advantageously benefit from the utilization of the process taught herein, include jet dyeing machines and winch-beck dyeing machines, also known simply as "beck" machines. The reason why such machines are noted to enjoy such benefits are in the nature in which the substrate to be dyed is handled: in both machines the substrate is mechanically moved through a dyeing liquor, and then moved through the trapped atmosphere within the machine, and then again in and through the dyeing liquor; and this process continues until satisfactory dyeing is achieved. This repetitive mechanical transport through the trapped atmosphere and then through the dyeing liquor and so on is a means whereby the gas content of the trapped atmosphere is introduced into the dyeing liquor by the entrained entrapment of the gas within the substrate. Such a phenomenon is readily understandable to the skilled practitioner and is a major means by which entrained atmospheric oxygen may be introduced into the aqueous sulphur dye dyebath composition. Whereas this does not necessarily provide a detrimental effect wherein the sulphur dye dyebath is one where sulphide is used as the reducing agent, the adverse has been found to be true where a non-sulphide type reducing agent is used in the presence of air of non-reduced oxygen level.

In an alternative embodiment steam may also be used as the flushing agent. The quality of the steam may be unsaturated, saturated, or supersaturated, but is preferably unsaturated or saturated steam and the pressure of the steam should be sufficient to drive out the trapped atmosphere of the dyeing apparatus and to effect flushing thereof. After the steam has flushed the atmosphere within the dyeing apparatus at a temperature below the boil, it generally cools and condenses, and thus forms a vacuum or reduced pressure condition (i.e. less than one atmosphere, i.e.<0.98 bar) within the dyeing apparatus which condition may or may not be desired. In cases wherein such a reduced pressure may be tolerated by the apparatus, and where a reduced pressure may be maintained, to achieve the desired reduced oxygen levels no further action need be required. However, in the case where such reduced pressures are undesired, after the condensation of the steam within the dyeing apparatus a supply of inert gas may be then introduced into the dyeing apparatus and thus form an inert gas blanket therein.

In a further alternative embodiment of the invention, the dye apparatus may be connected to a vacuum drawing apparatus such as a vacuum pump whereby the trapped atmosphere of the dyeing vessel is operated at a reduced pressure or vacuum. The use of such a vacuum apparatus may provide the benefit of insuring a constant flow of the inert gas from the gas supply, through the non-liquid portion of the dyeing vessel, and out through the vacuum drawing apparatus. This latter method, while requiring a constant sweep of inert gas through the dyeing machine provides the further benefit of insuring that where such apparatus is not perfectly hermetically sealed, any oxygen from the atmosphere entering the interior of the vessel is also drawn out and is not retained. The operating pressure of such a vacuum apparatus may be at any pressure which is found to be effective to achieve these above-identified effects that is, preferably at a pressure slightly less than the inlet pressure of the inert gas which may be supplied to the dyeing apparatus.

In a still further embodiment, the vacuum apparatus may be operated solely without the simultaneous operation of the inert gas supply and in such manner that the inert gas which had been previously supplied to the dye apparatus is slowly withdrawn therefrom and a reduced pressure is generated within the non-liquid volume of the dyeing vessel.

Further dyeing assistants may, if desired, be employed in the process of the invention, in particular wetting agents, defoamers, deaerating agents, water soluble mineral salts (preferably sodium sulphate or chloride) and—in order to adjust the pH to the desired value—bases (e.g. alkali metal hydroxides or carbonates) or acids (in particular low molecular aliphatic carboxylic acids e.g. with 2–4 carbon atoms, preferably acetic acid) as per se conventional in dyeing. The concentration of any added soluble mineral salts (in particular as exhaust adjuvant) may be kept at very low levels, e.g.≦30 g/l (0 to 30 g/l) referred to the dye liquor.

Preferably the first (exhaustion) stage of the dyeing process concludes with a rinsing step which is advantageously carried out while the atmosphere of reduced oxygen level is still present. Most preferably, this rinsing step is carried out until the dyebath is clear.

After completion of the exhaustion stage the treated goods are subjected in a second stage to an oxidative treatment, in particular with an oxidizing agent (B). In this second stage, which is advantageously carried out under acidic conditions, the dye is oxidized on the fibre in order to achieve color development and a degree of fastness.

Any oxidizing agent conventional pre se for sulphur dyes may be employed as (B), e.g. a gaseous form of oxygen (e.g. oxygen, ozone, air, or air enriched with oxygen and/or ozone, or a blend of inert gas with oxygen and/or ozone), hydrogen peroxide or preferably an oxidizing salt, e.g. sodium or potassium perborate, percarbonate, bichromate, chlorate, iodate or bromate, the latter preferably in the presence of a suitable activator such as alkali metal metavanadate; of these the bromate is particularly preferred, especially in the presence of sodium or potassium metavanadate.

For the second stage, i.e. for the oxidative stage, the atmosphere of reduced oxygen level of the first stage may be released or reset to a higher oxygen level, advantageously>12%, preferably>15%, more preferably>18% by volume, e.g. up to 21% by volume or even more. This is advantageously achieved by introduction of a gaseous form of oxygen as described above, e.g. by releasing a previous vacuum or reduced pressure by venting the highly inert atmosphere of the first stage or/and by introduction of a gaseous form of oxygen at overpressure, e.g. between 0.1 and 2 bar, e.g. when draining the reducing dyebath and/or optionally after the aforementioned rinsing step. According to a particular feature of the invention the raising of oxygen level before the second stage is carried out by introducing air, advantageously at an overpressure in the range of 0.2 to 1.5 bar, preferably 0.4 to 1 bar. The oxidation with the dissolved oxidant in the presence of this "air pad" is of particular advantage and leads to dyeings of optimum yield and fastness.

The oxidizing bath expediently contains an efficient amount of oxidizing agent (B), which is preferably an oxidizing salt ($B_1$), advantageously in the range of 0.2 to 12 g/l, preferably 0.5 to 5 g/l, more preferably 1 to 2 g/l referred to the volume of the liquor. The liquor-to-goods ratio is advantageously in the same scope as in the first stage. The oxidation is advantageously carried out with mild heating, preferably in the temperature range of 40° to 75° C., more preferably 49° to 71° C., and at a pH in the range of 4 to 6, preferably 4.5 to 5.5.

Upon completion of the second stage the oxidized goods may be rinsed and neutralized, e.g. with sodium carbonate, as conventional pre se after a sulphur dye dyeing, and completed in conventional way e.g. by rinsing, drying and/or, if desired, finishing in any suitable way with conventional finishing agents.

According to the invention there may be achieved very level, clear dyeings of high yield and intensity and of notable fastnesses, e.g. light fastness, wet fastnesses (in particular fastness to washing and to crocking).

In addition to the use of a non-sulphide reducing agent (R), the further benefits of the invention are many. These include: a) the elimination of the undesired oxidation of the reduced sulphur dye in the dyebath, also known as premature oxidation of dyestuff, which leads to a more effective and more reproducible dyeing operation as the reduction bath is more easily controlled and less bronzing of dyestuff occurs; b) under the dyeing conditions of reduced oxygen levels taught herein, lower liquor-to-goods ratios are possible which allow for increased dye exhaustion thereby improving the overall efficiency of the dyeing process and reducing the amount of spent dye waste discharged in the effluent and conveyed to reclaiming or waste water depuration; c) lower concentrations of salt are required while dyeing at lower liquor-to-goods ratios thereby reducing the amount of electrolyte discharged to the effluent; d) lower water consumption and energy requirements due to the lower liquor-to-goods ratios possible by the inventive process reduces the total cost of the dyeing process; and, e) due to the dyeing conditions of reduced oxygen level achieved by this process, lower amounts of chemical reducing agents are required to maintain a stable reduction bath for the application of the sulphur dye [i.e. a stable reduction bath is achieved using lesser amount of the non-sulphide reducing agent (R) than would be required under otherwise identical conditions but with an unreduced oxygen level] thus reducing the amount of chemical by-products discharged to the effluent, reducing the cost of application of the dye and downstream waste recovery and/or waste treatment. In addition to the advantages mentioned above, the present inventive process allows for the application of all sulphur dye colors to cellulosic and/or cellulosic mixed-fiber materials in a closed vessel such as a jet or winch-beck dyeing machine, especially sulphur dyes other than sulphur black dyes. Further advantages although not clearly described herein will also be apparent to a skilled practitioner in the relevant art.

Examples of the operation of the invention are described below. It is to be understood that these examples are provided by way of illustration and are not intended to be understood as limiting the scope of the present invention.

EXAMPLES

Example 1

A dyeing of a textile substrate in a jet dyeing apparatus is performed as follows: 500 g of 100% cotton knit jersey are loaded into a Mathis Laboratory Jet Type JFO dyeing machine. The dyeing machine is then filled with 4500 g of an aqueous solution containing 1 g of ethylenediaminetetraacetic acid sodium salt, 60 g of sodium carbonate, 35 g glucose and 175 g of sodium sulphate. This chemical bath is then heated to 49° C. while the fabric is transported through the machine. During this time, in order to render the atmosphere inert, nitrogen is charged into the dyeing vessel until an overpressure of 0.6 bar is reached, at which time the vessel is vented and recharged with nitrogen. This process is carried out until 5 nitrogen purges are given, and the pressure in the vessel vented so as to begin the dyeing at atmospheric pressure. Then, an aqueous solution containing 27 g of C.I. Leuco Sulphur Black 1 is introduced into the dyeing vessel via a metering pump. The dyeing machine is then heated to 93° C. at a rate of 2.8° C. /minute and held at this temperature for 45 minutes. The jet dyeing machine is then cooled to 71° C. and overflow rinsed with water until the dyebath is clear. 10 g of an aqueous solution containing 1.2 g of sodium bromate and 0.1 g of sodium metavanadate, and 5 g of glacial acetic acid are then added and the bath subsequently heated to 60° C. and maintained at this temperature for 10 minutes. This bath is then drained and the jet dyeing machine refilled with water. The fabric is rinsed for 5 minutes and the machine drained and refilled with water. To this bath are added 5 g of sodium carbonate and the machine is then heated to 88° C. and held for 10 minutes. A full black dyeing of the textile having good levelness is obtained.

Example C1

A dyeing operation under identical conditions as that described in Example 1 except for the omission of the inerting procedure via the nitrogen purging operation; only a medium depth black dyeing exhibiting poor uniformity was obtained.

Example 2

A dyeing of a textile substrate in a jet dyeing apparatus is performed as follows: 500 g of 100% cotton knit jersey are loaded into a Mathis Laboratory Jet Type JFO dyeing machine. The dyeing machine is then filled with 4500 g of an aqueous solution containing 1 g of ethylenediaminetetraacetic acid sodium salt, 60 g of sodium carbonate, 35 g glucose and 175 g of sodium sulphate. This chemical bath is then heated to 49° C. while the fabric is transported through the machine. During this time in order to render the atmosphere inert, nitrogen is charged into the dyeing vessel until a superatmospheric pressure of 0.6 bar is reached at which time the vessel is vented and recharged with nitrogen. This process is carried out until 5 nitrogen purges are given, and the pressure in the vessel vented so as to begin the dyeing at atmospheric pressure. Then, an aqueous solution containing 27 g of C.I. Leuco Sulphur Blue 20 is introduced into the dyeing vessel via a metering pump. The dyeing machine is then heated to 93° C. at a rate of 2.8° C. /minute and held at this temperature for 45 minutes. The jet dyeing machine is then cooled to 71° C. and overflow rinsed with water until the dyebath is clear. 10 g of an aqueous solution containing 1.2 g of sodium bromate and 0.1 g of sodium metavanadate, and 5 g of glacial acetic acid are then added and the bath is subsequently heated to 60° C. and maintained at this temperature for 10 minutes. This bath is then drained and the jet dyeing machine refilled with water. The fabric is rinsed for 5 minutes and the machine drained and refilled with water. To this bath are added 5 g of sodium carbonate and the machine is then heated to 88° C. and held for 10 minutes. A heavy navy dyeing exhibiting good levelness is obtained.

Example C2

A dyeing operation under identical conditions as that described in Example 2 except for the omission of the atmosphere inerting procedure via the nitrogen purging operation; a weak blue dyeing of the textile exhibiting poor uniformity was obtained.

Example 3

A dyeing of a textile substrate in a jet dyeing apparatus is performed as follows: 500 g of 100% cotton knit jersey are loaded into a Mathis Laboratory Jet Type JFO dyeing machine. The dyeing machine is then filled with 4500 g of an aqueous solution containing 1 g of ethylenediaminetetraacetic acid sodium salt, 60 g of sodium carbonate, 35 g glucose and 175 g of sodium sulphate. This chemical bath is then heated to 49° C. while the fabric is transported through the machine. During this time in order to render the atmosphere inert, nitrogen is charged into the dyeing vessel until a superatmospheric pressure of 0.6 bar is reached at which time the vessel is vented and recharged with nitrogen. This process is carried out until 5 nitrogen purges are given, and the pressure in the vessel vented so as to begin the dyeing at atmospheric pressure. Then, an aqueous solution containing 27 g of C.I. Leuco Sulphur Blue 20 is introduced into the dyeing vessel via a metering pump. The dyeing machine is then heated to 93° C. at a rate of 2.8° C. /minute and held at this temperature for 45 minutes. The jet dyeing machine is then cooled to 71° C. and overflow rinsed with water until the dyebath is clear. An air pad of 0.4 to 1 bar overpressure is applied and repeated three times, to raise the oxygen content of the atmosphere within the vessel to a level>15%, between 15 and 21% by volume. 10 g of an aqueous solution containing 1.2 g of sodium bromate and 0.1 g of sodium metavanadate, and 5 g of glacial acetic acid are then added and the bath is subsequently heated to 60° C. and maintained at this temperature for 10 minutes. This bath is then drained and the jet dyeing machine refilled with water. The fabric is rinsed for 5 minutes and the machine drained and refilled with water. To this bath are added 5 g of sodium carbonate and the machine is then heated to 88° C. and held for 10 minutes. A heavy navy dyeing exhibiting good levelness is obtained.

Example 4

A dyeing of a textile substrate in a jet dyeing apparatus was performed as follows 500 g of 100% cotton knit interlock are loaded into a Mathis Laboratory Jet Type JFO dyeing machine. The dyeing machine is then filled with 4500 g of an aqueous solution containing 1 g of ethylenediaminetetraacetic acid sodium salt, 15 g of sodium carbonate, 25 g of sodium hydroxide 50%, 17.7 g glucose and 100 g of sodium sulphate. This chemical bath is then heated to 49° C. while the fabric is transported through the machine. During this time, nitrogen is charged into the dyeing vessel until an overpressure of 0.6 bar is reached at which time the vessel is vented and recharged with nitrogen. This procedure is repeated until 3 nitrogen purges are given, and the pressure in the vessel is then vented so as to begin the dyeing at atmospheric pressure. Then, an aqueous solution containing 2.7 g of C.I. Leuco Sulphur Blue 13 is introduced into the dyeing vessel via a metering pump. The dyeing machine is then heated to 93° C. at a rate of 2.8° C. /minute and held at this temperature for 45 minutes. The jet dyeing machine is then cooled to 71° C. and overflow rinsed with water until the dyebath is clear. 10 g of an aqueous solution containing 1.2 g of sodium bromate and 0.1 g of sodium metavanadate and 5 g of glacial acetic acid are then added and the bath is subsequently heated to 60° C. and maintained at this temperature for 10 minutes. This bath is then drained and the jet dyeing machine refilled with water. The fabric is rinsed for 5 minutes and the machine drained and refilled with water. To this bath are added 5 g of sodium carbonate and the machine is then heated to 88° C. and held for 10 minutes. A light powder-blue dyeing of the textile having good levelness is obtained.

Example C4

A dyeing operation under identical conditions as that described in Example 4 except for the omission of the atmosphere inerting procedure via the nitrogen purging operation; a very weak blue dyeing of the textile exhibiting poor uniformity was obtained.

Example 5

The dyeing procedure as described in Example 4 is repeated, except that 16 g of C.I. Leuco Sulphur Blue 20 is used in the place of the 2.7 g of C.I. Leuco Sulphur Blue 13, and dyeing is performed for 45 minutes at 71° C. instead of 93° C. A heavy navy dyeing of the textile having good levelness is obtained.

Example 6

2500 g of a 100% cotton knit textile is loaded into a Benz Laboratory Winch-Beck Type LH dyeing machine. The dyeing machine is then filled with 50 liters of an aqueous solution containing 2.6 g of ethylenediaminetetraacetic acid sodium salt, 200 g of an aqueous 50% sodium hydroxide solution, 200 g glucose and 2250 g of sodium sulphate. This chemical bath is then heated to 49° C. while the fabric is transported through the machine. During this time, nitrogen is charged into the dyeing vessel, both sparging the bath and purging the atmosphere within the vessel, and forms an inert gas blanket over the dyebath. Then, an aqueous solution containing 90 g of C.I. Solubilized Sulphur Black 2 is introduced into the dyeing vessel. The fabric is transported through the dyebath for 10 minutes while the temperature is maintained at 49° C. The dyeing machine is then heated to 82° C. and maintained at this temperature for 20 minutes. The fabric is then overflow rinsed with water until the dyebath is clear. 50 g of an aqueous solution of 6 g of sodium bromate and 0.5 g of sodium metavanadate, and 25 g of glacial acetic acid are then added and the bath is then heated to 66° C. and held at this temperature for 15 minutes. This bath is then drained and the winch-beck dyeing machine refilled with water. The fabric is rinsed 5 minutes and the machine drained and refilled with water. To this bath are added 50 g sodium carbonate and the machine is then heated to 71° C. and held at that temperature for 10 minutes. A full black dyeing exhibiting good levelness is obtained.

Example C6

A dyeing operation under identical conditions as that described in Example 6 except for the omission of the atmosphere inerting procedure via the nitrogen purging operation; a full black dyeing of the textile exhibiting poor uniformity was obtained.

Example 7

A jet dyeing machine is loaded with a cotton textile material to be dyed and enough water to give a liquor-to-goods ratio of about 10:1 and the contents are heated to 49° C. To the heated bath are added 0.5 g/l of a 40% aqueous solution of ethylenediaminetetraacetic acid sodium salt, 0.5 g/l of SODYECO Defoamer DSV (proprietary mixture of petroleum derivatives), 25 g/l of sodium sulphate, 5 g/l of soda ash, 5 g/l of aqueous 50% caustic soda and 5 g/l of a mixture of 94.5% by weight of glucose, 5% by weight of sodium lignin sulphonate and 0.5% by weight of dedusting oil. To the resulting mixture is added gradually over 5 minutes an amount of an aqueous suspension containing 33% by weight of the dye C.I. Sulphur Black 1 sufficient to provide 16% dye based on the weight of the textile material and the resulting mixture is heated to 71° C., at a rate of 2.75° C. /min. while the atmosphere above the liquor in the apparatus is being purged with nitrogen. The resulting dyebath is then heated to 93° C. at a rate of 2.75° C. /min. and held at that temperature for 45 minutes. The dyebath is then cooled to 71° C. and the contents are overflow rinsed with unheated water until the bath water is clear. The liquor-to-goods ratio is readjusted to 10:1 and the bath is heated to 49° C., while the interior of the apparatus is aerated. 2 g/l of acetic acid of 56% strength and 2 g/l of an aqueous 12% sodium bromate/1% sodium metavanadate solution are added and the resulting oxidation bath is heated to 65° C. and held at that temperature for 10 minutes. The bath is then overflow rinsed and drained and the apparatus is refilled with water to which 1 g/l of soda ash is added. The dyed textile material is then scoured in the resulting liquor for 10 minutes at 88° C. The bath is then cooled to 71° C. and the dyed material is removed therefrom.

In the above Examples ethylenediaminetetraacetic acid sodium salt may be employed in the form of a commercially available chelating agent SULFALOX 100 (an aqueous alkaline solution of ethylenediaminetetraacetic acid), C.I. Leuco Sulphur Black 1 may be employed in the form of the commercial dye SANDOZOL Black 4G-RDT Liquid, C.I. Leuco Sulphur Blue 13 may be employed in the form of the commercial preparation SANDOZOL Blue 2GB-RDT Liquid, C.I. Leuco Sulphur Blue 20 may be employed in the form of the commercial dye SANDOZOL Navy GF-RDT Liquid, C.I. Solubilized Sulphur Black 2 may be employed in the form of the commercial preparation SANDOZOL Black R Powder and the mixture of sodium bromate and sodium metavanadate may be employed in the form of commercially available aqueous solutions of sodium bromate/sodium metavanadate such as DYETONE or CHEM-OXY SG Example 8 a) The reaction mixture obtained by a conventional thionation reaction for producing C.I. Sulfur Black 1 dye is aerated at 65°–75° C. and pH 9.5 until acidification of a sample of the resulting slurry to pH 3 with phosphoric acid at 22° C. generates only enough hydrogen sulfide to produce, upon dissolution in an excess of aqueous sodium hydroxide, less than 50 ppm of sulfide ion, based on the weight of the dye. The rate of aeration is about 15 $m^3$ per minute per kilo of thionation reaction mixture. The slurry is filtered and 1918 grams of the resulting presscake, having a solids content of 65.7%, is mixed with 1082 grams of water with stirring. To this mixture is added 11.3 grams of 98% sulfuric acid, whereby the pH is lowered from 8.9 to 7.5, and then 6 grams of xanthan gum (KELZAN from Kelco, a unit of Monsanto Company) are added slowly at room temperature to the upper portion of the vortex created by rapid stirring of the mixture. To the resulting suspension are added 750 grams of water to adjust the dyeing strength and an additional 1.5 grams of xanthan gum. The resulting product has a viscosity of 800 cP and, when acidified to pH 3 with phosphoric acid at 22° C., generates less hydrogen sulfide than can produce 50 ppm of sulfide ion in aqueous sodium hydroxide, as measured by ion chromatography.

b) A jet dyeing machine is loaded with a cotton textile material to be dyed and enough water to give a liquor:goods ratio of about 10:1 and the contents are heated to 49° C. To the heated bath are added 0.5 g/L of a 40% aqueous solution of ethylenediaminetetraacetic acid sodium salt, 0.5 g/L of SODYECO Defoamer DSV (proprietary mixture of petroleum derivatives), 25 g/L of sodium sulfate, 5 g/L of soda ash, 5 g/L of aqueous caustic soda (50%) and 5 g/L of a mixture of 94.5%, by weight, glucose, 5% reductive dispersing agent and 0.5% dedusting oil. To the resulting mixture is added gradually over 5 minutes an amount of the product part (a) above sufficient to provide 16% dye based on the weight of the textile material and the resulting mixture is heated to 71° C. at a rate of 2.75° C. /min. while the atmosphere above the liquor in the apparatus is being purged with nitrogen. The resulting dyebath is then heated to 93° C. at a rate of 2.75° C. /min. and held at that temperature for 45 minutes. The dyebath is then cooled to 71° C. and the contents are overflow rinsed with unheated water until the bath water is clear. The liquor:goods ratio is readjusted to 10:1 and the bath is heated to 49° C. while the interior of the apparatus is aerated. Two g/L of acetic acid (56%) and g/L of an aqueous 12% sodium bromate/1% sodium vanadate solution are added and the resulting oxidation bath is heated to 65° C. and held at that temperature for 10 minutes. The bath is then overflow rinsed and drained and the apparatus is refilled with water to which 1 g/L of soda ash is added. The dyed textile material is then scoured in the resulting liquor for 10 minutes at 88° C. The bath is then cooled to 71° C. and the dyed material is removed therefrom.

I claim:

1. A process for exhaust dyeing cellulosic fibrous material with a sulfur dye, which process comprises contacting the fibrous material with an aqueous dyebath that contains at least one sulfur dye (S) in at least partially soluble form ($S_A$) and at least one non-sulfide reducing agent (R), in an atmosphere of reduced oxygen level comprising an inert gas in a closed vessel and then oxidizing by treatment with an oxidizing salt in an oxidizing bath, said atmosphere of reduced oxygen level being maintained during exhaustion of the dyebath.

2. A process according to claim 1, wherein the non-sulphide reducing agent (R) is an organic reducing agent selected from the group consisting of a reducing sugar, hydroxyacetone, glyceraldehyde, sodium formaldehyde sulphoxylate, formamidine sulphinic acid and thioglycolic acid.

3. A process according to claim 1 or 2, wherein (S) is selected from ($S_1$) a sulphur dye in oxidized form, ($S_2$) a (pre)reduced sulphur dye, ($S_3$) a solubilized sulphur dye (Bunte salt).

4. A process according to claim 2, wherein the sulphur dye (S) is a non-soluble oxidized sulphur dye ($S_1'$) whose at least partially soluble form ($S_A$) is formed in the (R)-containing dyebath.

5. A process according to claim 1, wherein the dyeing is carried out with at least one sulphur dye in at least partially soluble and at least partially reduced form ($S_A'$) under alkaline conditions.

6. A process according to claim 1, wherein the reducing agent (R) is present in a lesser amount than would be required to maintain an equally stable reduction bath under otherwise identical conditions but in an atmosphere having an oxygen level of normal air.

7. A process according to claim 1, wherein the oxidation is carried out under neutral to acidic conditions.

8. A process according to claim 1, which is carried out in a jet dyeing machine or in a winch beck.

9. A process according to claim 1 wherein the oxidizing salt is sodium perborate, sodium percarbonate, sodium bichromate, sodium chlorate, sodium iodate, sodium bromate, potassium perborate, potassium percarbonate, potassium bichromate, potassium chlorate, potassium iodate or potassium bromate.

10. A process according to claim 1, wherein the reduced oxygen level is obtained by applying a vacuum or reduced pressure.

11. A process according to claim 1, wherein the added inert gas is selected from nitrogen, a noble gas, steam or carbon dioxide or a mixture of two or more thereof.

12. A process according to claim 1, wherein (R) is employed in combination with a chelating agent (C).

13. A process according to claim 1, wherein the fibrous material which has been contacted with the aqueous dyebath is rinsed in the presence of the atmosphere of reduced oxygen level prior to oxidizing.

14. A process according to claim 11 wherein the inert gas is nitrogen.

15. A process according to claim 5, wherein after the dyeing with ($S_A$') and before oxidation, the oxygen level of the atmosphere in the vessel is raised by addition of oxygen.

16. A process according to claim 1, wherein the sulfur dye(S) is a non-soluble oxidized sulfur dye ($S_1$') whose at least partially soluble form ($S_A$) is formed in the (R)-containing dyebath.

17. A process according to claim 1 wherein the atmosphere of reduced oxygen level contains no more than 12% oxygen, by volume.

18. A process according to claim 17 wherein the oxidizing is carried out in an atmosphere containing more than 15% oxygen, by volume.

19. A process according to claim 18 wherein, after the fibrous material is contacted with the aqueous dyebath in the atmosphere of reduced oxygen level and before the oxidation, the oxygen level of the atmosphere in the vessel is raised by addition of oxygen.

20. A process according to claim 19 wherein the oxidizing salt is employed in an amount in the range 0.2 to 12 g/l.

21. A process according to claim 19 wherein the fibrous material which has been contacted with the aqueous dyebath is rinsed in the presence of the atmosphere of reduced oxygen level prior to oxidizing.

22. A process according to claim 18 wherein the oxidizing salt is employed in an amount in the range 0.2 to 12 g/l.

23. A process according to claim 19 wherein the added inert gas is selected from nitrogen, a noble gas, steam, carbon dioxide of a mixture of two or more thereof and the non-sulphide reducing agent (R) is selected from the group consisting of sodium borohydride, hydroxylamine sulphate, lignin sulphonates, sodium hydrosulphite, reducing sugars, hydroxyacetone, glyceraldehyde, sodium formalehyde sulphoxylate, formamidine sulphinic acid and thioglycolic acid.

24. A process according to claim 23 wherein the inert gas is nitrogen.

25. A process according to claim 18 wherein the fibrous material which has been contacted with the aqueous dyebath is rinsed in the presence of the atmosphere of reduced oxygen level prior to oxidizing.

26. A process according to claim 1 wherein the atmosphere of reduced oxygen level contains no more than 7% oxygen, by volume.

27. A process according to claim 26 wherein the oxidizing is carried out in an atmosphere containing more than 18% oxygen, by volume.

28. A process according to claim 27 wherein, after the fibrous material is contacted with the aqueous dyebath in the atmosphere of reduced oxygen level and before the oxidation, the oxygen level of the atmosphere in the vessel is raised by addition of air.

29. A process according to claim 27 or 28 wherein the oxidation is effected by treatment of the fibrous material in an oxidizing bath with an oxidizing salt in an amount in the range 0.5 to 5 g/l.

30. A process according to claim 29 wherein the atmosphere of reduced oxygen level comprises added nitrogen gas and the non-sulphide reducing agent is a reducing sugar.

31. A process according to claim 29 wherein the concentration of the reducing agent (R) is in the range 1 to 10%, based on the dry weight of the fibrous material.

32. A process according to claim 29 wherein the fibrous material which has been contacted with the aqueous dyebath is rinsed in the presence of the atmosphere of reduced oxygen level prior to oxidizing.

33. A process according to claim 1 wherein, after the fibrous material has been contacted with the aqueous dyebath in the atmosphere of reduced oxygen level and before the oxidation, the oxygen level of the atmosphere in the vessel is raised by addition of oxygen.

34. A process according to claim 25 wherein the inert gas is nitrogen.

35. A process according to claim 1 wherein the reducing agent (R) is present in a concentration in the range 0.5 to 15%, based on the dry weight of the fibrous material.

36. A process according to claim 1 wherein the reduced oxygen level is in the range 0.5 to 7.0%, by volume.

37. A process according to claim 1 which comprises repetitive transport of the fibrous material through the atmosphere of reduced oxygen level and then through the dyebath.

38. A process according to claim 1 wherein the sulphur dye (S) is a yellow, orange, red, violet, blue, green or brown dye or a combination thereof.

39. A process according to claim 26 wherein the inert gas is nitrogen.

* * * * *